United States Patent [19]

Binoche

[11] 4,307,820

[45] Dec. 29, 1981

[54] COVER FOR PAINT-SPRAY GUN CONTAINER

[75] Inventor: Michel Binoche, Stains, France

[73] Assignee: SKM Société Anonyme, France

[21] Appl. No.: 175,926

[22] Filed: Aug. 6, 1980

[30] Foreign Application Priority Data

Nov. 2, 1979 [FR] France ..... 79 27111

[51] Int. Cl.[3] ..... B65D 51/16

[52] U.S. Cl. ..... 220/374; 220/367

[58] Field of Search ..... 220/300, 367, 373, 374

[56] References Cited

U.S. PATENT DOCUMENTS 2,622,770 12/1952 Penno ..... 220/300

3,067,907 12/1962 Friend ..... 220/374 X 4,026,512 5/1977 Holt ..... 220/367 X

FOREIGN PATENT DOCUMENTS 2439080 4/1976 France .

*Primary Examiner*—George T. Hall

[57] ABSTRACT

A lid having therethrough a vent hole which lets in air for compensating the paint sprayed, but does not let the paint leave if it is submerged following too great an inclination of the spray gun.

This vent hole is formed by a groove of great length and small section, having any shape, emerging on one side inside the container 3 and on the other side outside lid 2, provided for this purpose in one of two complementary surfaces, able to be sealingly applied one against the other, one of which forms part of the lid and the other a removable part. It may be in particular in the form of a bore provided in the lid, in which bore a threaded plug is disposed with a tight fit.

3 Claims, 2 Drawing Figures

COVER FOR PAINT-SPRAY GUN CONTAINER

BACKGROUND OF THE INVENTION

Paint-spray guns are most often supplied with paint from a container fixed under the spray gun; the paint is drawn into this container by the depression created at the outlet of the paint nozzle by the current of compressed air which pulverizes it and projects it onto the workpiece to be painted.

A lid is removably fixed to the container and said lid is itself fixed permanently to the spray gun. So as to allow the spray gun to be used for spraying paint downwards, for example onto workpieces placed on a table, or upwards, for example onto a "ceiling", the closure between the container and its lid must necessarily be airtight while allowing air to enter the container, as the paint is drawn therein and leaves therefrom. A vent hole is then always provided in the lid generally fairly close to the center thereof, on the handle side, so that spraying may be possible, either upwards or downwards; this arrangement allows the spray gun to be inclined more downwards than upwards, but it is more frequent to have to spray the paint downwards and this work requires the spray gun to be inclined. On the other hand, if the container is full and if the spray gun is very inclined, there is a danger of the paint flowing out through the vent hole.

If the paint flows through the vent hole when the spraying takes place from top to bottom, paint droplets may fall onto the workpiece being painted and cause, for this reason, inacceptable defects; the same is not true for upward painting.

To avoid this risk, attempts have been made to provide covers for paint-spray gun containers pierced with a vent hole which allows air to enter so as to compensate for the paint which is sprayed, but does not let the paint flow through if it is submerged following too great an inclination of the spray gun.

Numerous solutions have been proposed with a view to obtaining this result; they generally give satisfaction insofar as the vent hole provided for the air intake has not been stopped up by the paint, which causes interruption of the paint supply at the spray gun; however, in all the solutions provided up to present, cleaning of the stopped-up air intake is difficult, if not practically impossible, because it is a question of very small section passages, often of a great length, and curved to a greater or lesser degree.

SUMMARY OF THE INVENTION

The present invention provides a lid for a paint-spray gun container pierced with a vent hole which allows air to flow in for compensating the paint sprayed, but does not let the paint flow out if it is submerged following too great an inclination of the spray gun, arranged so as to facilitate cleaning if this hole is stopped up by the paint.

For this, the lid is characterized in that its vent hole is formed by a groove of great length and small section, having any form, emerging at one side inside the container, and on the other side outside the lid, provided for this purpose in one of two complementary surfaces, able to be sealingly applied one against the other, one of which forms part of the lid, and the other a removable part.

For reasons of convenience in manufacture and cleaning, the groove may be preferably in a surface of the movable part, which may be in the form of a plug, or a lid, for the lid for the container in accordance with the present invention.

Cleaning of this groove may be carried out easily with a brush and solvent, which the user always has at his disposal for cleaning the spray gun, after separating the lid from the container, the movable part comprising this rib in one of its surfaces, to which he has free access.

It should moreover be noted that, when the spray gun is operating, a vacuum is formed in the container, and consequently a compensatory air intake which can only penetrate therein through the vent hole of its lid by carrying with it inside the container the paint which it may contain, and by maintaining this vent hole clean.

The length and the section of this vent hole must be such that the time required for the paint to pass therethrough and to flow out of the container is greater than that of an operation during which the spray gun is used in a position likely to cause this flow.

There exist numerous embodiments of the lid of the present invention; according to one of them, particularly simple, the lid of the container is pierced with a bore having a threaded plug engaged therein with a sufficiently tight fit; a mechanical device for locking the plug in the closed position is preferably provided to avoid any risk of it escaping when the spray gun is turned over.

The thread of the plug has preferably a truncated cone shape or square threads, so as to avoid more reliably the paint from passing direct between the threads and the wall of the bore of the lid, instead of following the long helical path created by the thread of the plug.

DESCRIPTION OF THE DRAWINGS

The accompanying drawings show by way of example one such embodiment of the present invention.

DESCRIPTION OF THE PREFERRED EMBODIMENT

Figure 1:
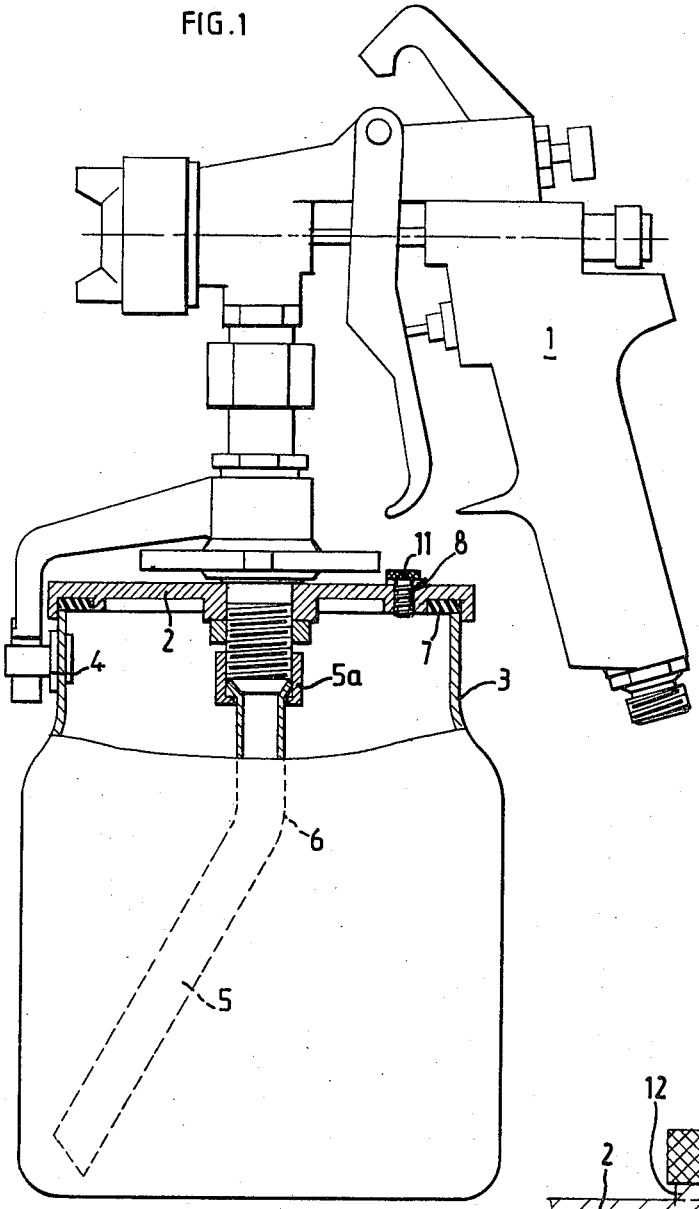
FIG. 1 is a view, partially in elevation and partially in section, of a spray gun fitted with such a container, whose lid is constructed in accordance with the present invention.
Figure 2:
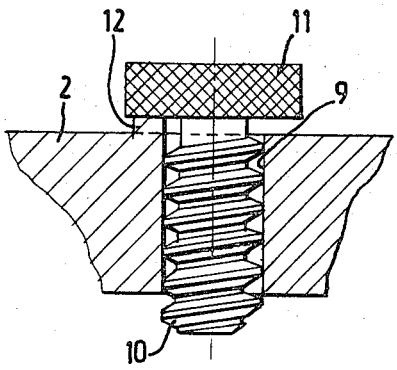
FIG. 2 is a sectional view, on a larger scale, of the bore pierced in the cover with the threaded plug forming therewith the desired vent.

On spray gun 1 is fixed the lid 2 of the container 3 by means of a stud 4 and a yoke. The paint is drawn into the bottom of the container through a plunger tube 5, generally bent forwards, as shown in FIG. 1. Its bend 6 allows the paint to be drawn up even if the amount remaining in the container is small when spraying downwards.

For working upwards, on a "ceiling", tube 5 is rotated by 180° by acting on nut 5*a* which secures it, the bent end being then directed towards the handle.

The seal between container 3 and its lid 2 is provided by seal 7. Numerous systems are known for securing the container to the lid.

Vent 8 is formed in lid 2 by a bore 9 more or less elongated in which there is fitted, with a tight fit so that it does not risk coming loose, a threaded plug 10 having a head 11 on which a stop 12 prevents it from coming into contact with lid 2, thus forming a free passage for the air which must penetrate into the container 3, and facilitating extraction thereof in the case of need.

Without being obliged to elongate inconveniently bore 9 of the lid, there is created with the thread of plug 11 a helical passage small in section and of great length which the paint will not have time to flow through during the time that the spray gun is held upside down, the paint then covering the part of the lower surface of the lid in which emerges bore 9 in which the vent is created.

It will be readily understood that the embodiment which has been described above with reference to the accompanying drawing has been given purely by way of indication and is in no wise limiting and that numerous modifications may be made without departing from the scope and spirit of the present invention; thus, in order to facilitate removal of plug 10 if the paint left between the threads of the plug and the bore 9 of the lid in which it is engaged becomes hard, one or other may be conical instead of being cylindrical.

What is claimed is:

1. A lid for a paint-spray gun container pierced with a vent which lets in the air for compensating the paint sprayed, but does not let the paint flow out if it is submerged following too great an inclination of the spray gun, wherein the vent is formed by a bore formed in the lid, a threaded plug is disposed with a tight fit in said bore and a stop limits the penetration of said plug into said bore of said lid.

2. The lid as claimed in claim 1, wherein the threading of said plug has truncated teeth.

3. The lid as claimed in claim 1, wherein the threading of said plug comprises square threads.

* * * * *